US008936448B2

(12) United States Patent
Okamoto et al.

(10) Patent No.: US 8,936,448 B2
(45) Date of Patent: Jan. 20, 2015

(54) ROTARY COMPRESSOR HAVING MAIN CYLINDER CHAMBER AND SUB-CYLINDER CHAMBER WITH AN END PLATE RECEIVED THEREIN

(75) Inventors: Tetsuya Okamoto, Sakai (JP); Yoshitaka Shibamoto, Sakai (JP); Kazuhiro Furusho, Sakai (JP); Takazou Sotojima, Sakai (JP); Takayuki Kawano, Sakai (JP); Hiroshi Yoh, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 179 days.

(21) Appl. No.: 13/635,585

(22) PCT Filed: Mar. 18, 2011

(86) PCT No.: PCT/JP2011/001630

§ 371 (c)(1),
(2), (4) Date: Sep. 17, 2012

(87) PCT Pub. No.: WO2011/114750

PCT Pub. Date: Sep. 22, 2011

(65) Prior Publication Data

US 2013/0011290 A1 Jan. 10, 2013

(30) Foreign Application Priority Data

Mar. 19, 2010 (JP) ..... 2010-064814

(51) Int. Cl.

| | |
|---|---|
| ***F03C 2/00*** | (2006.01) |
| ***F03C 4/00*** | (2006.01) |
| ***F04C 11/00*** | (2006.01) |
| ***F04C 18/324*** | (2006.01) |
| F01C 21/08 | (2006.01) |
| ***F04C 23/00*** | (2006.01) |
| ***F04C 18/04*** | (2006.01) |

(52) U.S. Cl.

CPC ..... *F04C 18/324* (2013.01); *F01C 21/0809* (2013.01); *F04C 23/001* (2013.01); *F04C 18/045* (2013.01)

USPC ..... 418/11; 418/58; 418/59

(58) Field of Classification Search

USPC ..... 418/11–12, 55.5, 57–59

See application file for complete search history.

(56) References Cited

U.S. PATENT DOCUMENTS

| | | | |
|---|---|---|---|
| 2009/0074602 | A1 | 3/2009 | Masuda et al. |
| 2010/0319394 | A1 | 12/2010 | Furusho et al. |
| 2010/0326128 | A1 | 12/2010 | Sotojima et al. |

FOREIGN PATENT DOCUMENTS

| | | | |
|---|---|---|---|
| JP | 61-11488 | A | 1/1986 |
| JP | 2006-307762 | A | 11/2006 |
| JP | 2007-113493 | A | 5/2007 |
| JP | 4396773 | B2 | 10/2009 |
| JP | 2006-348773 | A | 12/2010 |
| WO | WO 2006/117940 | A1 | 3/2006 |

OTHER PUBLICATIONS

International Search Report of corresponding PCT Application No. PCT/JP2010/001630.

Extended European Search Report of corresponding EP Application No. 11 75 5940.1 dated Nov. 27, 2014.

*Primary Examiner* — Theresa Trieu

(74) *Attorney, Agent, or Firm* — Global IP Counselors

(57) ABSTRACT

A rotary compressor includes a cylinder having an annular cylinder space, a piston eccentrically disposed relative to the cylinder, and a drive shaft (53) connected to the piston. The piston has a piston portion eccentrically rotatable relative to the cylinder, and a piston end plate closing the cylinder space. The cylinder has an end plate storage space storing the piston end plate in an eccentrically rotatable manner. The cylinder space forms a main cylinder chamber, and the end plate storage space forms a sub-cylinder chamber.

5 Claims, 9 Drawing Sheets

(A)

(B)

ROTARY COMPRESSOR HAVING MAIN CYLINDER CHAMBER AND SUB-CYLINDER CHAMBER WITH AN END PLATE RECEIVED THEREIN

CROSS-REFERENCE TO RELATED APPLICATIONS

This U.S. National stage application claims priority under 35 U.S.C. §119(a) to Japanese Patent Application No, 2010-064814, filed in Japan on Mar. 19, 2010, the entire contents of which are hereby incorporated herein by reference.

TECHNICAL FIELD

The present invention relates to a rotary compressor having an eccentrically rotatable compression mechanism, particularly to a rotary compressor in which a plurality of cylinder chambers are formed in a compression mechanism by providing an annular piston in an annular cylinder chamber of a cylinder.

BACKGROUND ART

A rotary compressor in which a plurality of cylinder chambers are formed in a compression mechanism by providing an annular piston in an annular cylinder chamber of a cylinder has been proposed (see, e.g., Japanese Patent Publication Nos. 2007-113493 and 2006-307762). A compressor of Japanese Patent Publication No. 2007-113493 has two cylinder chambers formed inside and outside an annular piston. A compressor of Japanese Patent Publication No. 2006-307762 has three cylinder chambers.

In general, cycle efficiency of a refrigeration cycle improves when the number of compression stages in a compression stroke is increased. Thus, the compressor of Patent Document 1 can be used to perform a two-stage compression refrigeration cycle, and the compressor of Patent Document 2 can be used to perform a three-stage compression refrigeration cycle.

SUMMARY

Technical Problem

When the two-stage compression mechanism is modified to be a three-stage compression mechanism, or the three-stage compression mechanism is modified to be a four-stage compression mechanism to improve the efficiency of the compressors of Japanese Patent Publication Nos. 2007-113493 and 2006-307762, the number of cylinder chambers needs to be increased. To increase the number of the cylinder chambers, two large and small annular pistons need to be coaxially arranged, and the configuration of the mechanism is complicated. Even when two compression mechanisms are provided to increase the number of the cylinders, the configuration of the mechanism is complicated. Thus, increasing the number of the cylinder chambers increases parts count and fabrication costs, complicates the configuration, and increases the size of the compressor.

In view of the foregoing, the present invention has been achieved. The present invention is concerned with providing an eccentrically rotatable compression mechanism having a plurality of cylinder chambers without increasing the costs and complicating the configuration.

Solution to the Problem

A first aspect of the invention is directed to a rotary compressor including: a cylinder (21, 31) having annular cylinder space; a piston (22, 32) arranged to be eccentric to the cylinder (21, 31); and a drive shaft (53) connected to the piston (22, 32), the piston (22, 32) having a piston portion (22*a*, 22*b*, 32*a*, 32*b*) which eccentrically rotates relative to the cylinder (21, 31), and an end plate (22*c*, 32*c*) which closes the cylinder space.

In this rotary compressor, the cylinder (21, 31) has end plate storage space for storing the end plate (22*c*, 32*c*) of the piston (22, 32) in an eccentrically rotatable manner, and the cylinder space constitutes a main cylinder chamber (C1), and the end plate storage space constitutes a sub-cylinder chamber (C2).

According to the first aspect of the invention, when the main cylinder chamber (C1) includes two cylinder chambers, the compression mechanism has three cylinder chambers, i.e., the two cylinder chambers and the sub-cylinder chamber (C2). When the main cylinder chamber (C1) includes three cylinder chambers, the compression mechanism has four cylinder chambers, i.e., the three cylinder chambers and the sub-cylinder chamber (C2). In the present invention, space located radially outside the end plate, which is not generally used as the cylinder chamber, also functions as the cylinder chamber, i.e., one more cylinder chamber is provided.

In a second aspect of the invention related to the first aspect of the invention, the main cylinder chamber (C1) includes an innermost cylinder chamber (23*a*, 33*a*), an inner cylinder chamber (23*b*, 33*b*), and an outer cylinder chamber (23*c*, 33*c*) which are sequentially provided from inside to outside in a radial direction, and the sub-cylinder chamber (C2) forms an outermost cylinder chamber (23*d*, 33*d*) which is located radially outside the outer cylinder chamber (23*c*, 33*c*).

According to the second aspect of the invention, the main cylinder chamber (C1) includes the three cylinder chambers. Thus, the compression mechanism includes four cylinder chambers, i.e., the three cylinder chambers and the outermost cylinder chamber (23*d*, 33*d*) as the sub-cylinder chamber (C2).

In a third aspect of the invention related to the second aspect of the invention, the cylinder (21, 31) has an inner cylinder portion (21*a*, 31*a*), an outer cylinder portion (21*b*, 31*b*), and an outermost cylinder portion (21*c*, 31*c*) which are arranged concentrically about a center of rotation of the drive shaft (53), the outer peripheral surface of the piston (22, 32) has an annular inner piston portion (22*a*, 32*a*) and an annular outer piston portion (22*b*, 32*b*) which are arranged concentrically with an eccentric part formed on the drive shaft (53), and the end plate (22*c*, 32*c*) is arranged concentrically with the inner and outer piston portions (22*a*, 22*b*, 32*a*, 32*b*), the inner piston portion (22*a*, 32*a*) is arranged radially inside the inner cylinder portion (21*a*, 31*a*), and the outer piston portion (22*b*, 32*b*) is arranged between the inner cylinder portion (21*a*, 31*a*) and the outer cylinder portion (21*b*, 31*b*), the innermost cylinder chamber (23*a*, 33*a*) is formed between an outer peripheral surface of the inner piston portion (22*a*, 32*a*) and an inner peripheral surface of the inner cylinder portion (21*a*, 31*a*), the inner cylinder chamber (23*b*, 33*b*) is formed between an outer peripheral surface of the inner cylinder portion (21*a*, 31*a*) and an inner peripheral surface of the outer piston portion (22*b*, 32*b*), the outer cylinder chamber (23*c*, 33*c*) is formed between an outer peripheral surface of the outer piston portion (22*b*, 32*b*) and an inner peripheral surface of the outer cylinder portion (21*b*, 31*b*), and the outermost cylinder chamber (23*d*, 33*d*) is formed between an outer peripheral surface of the end plate (22*c*, 32*c*) and an inner peripheral surface of the outermost cylinder portion (21*c*, 31*c*).

According to the third aspect of the invention, among the four cylinder chambers of the compression mechanism, i.e., the innermost cylinder chamber (23*a*, 33*a*), the inner cylinder chamber (23*b*, 33*b*), the outer cylinder chamber (23*c*, 33*c*), and the outermost cylinder chamber (23*d*, 33*d*), the innermost cylinder chamber (23*a*, 33*a*), the inner cylinder chamber (23*b*, 33*b*), and the outer cylinder chamber (23*c*, 33*c*) are located relative to the same plane, while the outermost cylinder chamber (23*d*, 33*d*) is located relative to a different plane. A fluid such as a refrigerant is compressed using the four cylinder chambers.

In a fourth aspect of the invention related to the third aspect of the invention, the rotary compressor further includes: a blade (24, 34) configured to divide each of the cylinder chambers (23, 33) into a suction side chamber and a discharge side chamber, wherein the blade (24, 34) includes a swing bush (24*c*, 34*c*) which is swingably connected to the outer piston portion (22*b*, 32*b*), an inner blade portion (B1) which is located radially inside the swing bush (24*c*, 34*c*) and divides each of the innermost cylinder chamber (23*a*, 33*a*) and the inner cylinder chamber (23*b*, 33*b*) into a suction side chamber and a discharge side chamber, a first outer blade portion (B2) which is located radially outside the swing bush (24*c*, 34*c*) and divides the outer cylinder chamber (23*c*, 33*c*) into a suction side chamber and a discharge side chamber, and a second outer blade portion (B3) which is located radially outside the swing bush (24*c*, 34*c*) and divides the outermost cylinder chamber (23*d*, 33*d*) into a suction side chamber and a discharge side chamber. The swing bush (24*c*, 34*c*) may be integrally formed with the inner blade portion (B1), the first outer blade portion (B2), and the second outer blade portion (B3), or may be separated from the inner blade portion (B1), the first outer blade portion (B2), and the second outer blade portion (B3).

According to the fourth aspect of the invention, each of the four cylinder chambers is divided into the suction side chamber and the discharge side chamber by the corresponding blade portion. A fluid such as a refrigerant is compressed in each of the cylinder chambers divided into the suction side chamber and the discharge side chamber.

In a fifth aspect of the invention related to the fourth aspect of the invention, the cylinder (21, 31) is provided with a slide groove (21*f*, 21*g*, 31*f*, 31*g*) which holds the blade (24, 34) to be slidable in a direction of a surface of the blade, a first swing-permitting surface (n1) is formed in an outer peripheral surface of the inner piston portion (22*a*, 32*a*) to permit swing of the inner blade portion (B1) about the swing bush (24*c*, 34*c*) relative to the outer peripheral surface, and a second swing-permitting surface (n2) is formed in an outer peripheral surface of the end plate (22*c*, 32*c*) to permit swing of the second outer blade portion (B3) about the swing bush (24*c*, 34*c*) relative to the outer peripheral surface.

According to the fifth aspect of the invention, when the compression mechanism is operated, the blade (24, 34) slides in the slide groove (21*f*, 21*g*, 31*f*, 31*g*) formed in the cylinder (21, 31) in the direction of the surface of the blade (24, 34), and the piston (22, 32) swings about the swing bush (24*c*, 34*c*) as shown in FIG. 3. Since the first swing-permitting surface (n1) is formed in the outer peripheral surface of the inner piston portion (22*a*, 32*a*), and the second swing-permitting surface (n2) is formed in the outer peripheral surface of the end plate (22*c*, 32*c*), smooth movement of the cylinder (21, 31), the piston (22, 32), and the blade (24, 34) can be ensured during the operation of the compression mechanism.

In a sixth aspect of the invention related to the fifth aspect of the invention, the blade (24, 34) is made of an integrated member including the swing bush (24*c*, 34*c*), the first swing-permitting surface (n1) is formed based on a segment of a circle which forms a fine gap between the segment and a path of relative swing of the inner blade portion (B1) about the swing bush (24*c*, 34*c*), and the second swing-permitting surface (n2) is formed based on a segment of a circle which forms a fine gap between the segment and a path of relative swing of the second outer blade portion (B3) about the swing bush (24*c*, 34*c*).

According to the sixth aspect of the invention, when the blade (24, 34) swings about the swing bush (24*c*, 34*c*) in FIG. 6, the fine gap is formed between a tip end of the inner blade portion (B1) and the first swing-permitting surface (n1), and the fine gap is formed between a tip end of the second outer blade portion (B3) and the second swing-permitting surface (n2). In this case, the fine gaps may preferably be on the order of microns in which a lubricant forms an oil film.

In a seventh aspect of the invention related to any one of the first to sixth aspects of the invention, the compression mechanism includes two or more sets of the cylinder (21, 31) and the piston (22, 32).

According to the seventh aspect of the invention, two or more sets of the cylinder (21, 31) and the piston (22, 32) are provided, and the sub-cylinder chamber (C2) is provided radially outside the end plate (22*c*, 32*c*) of each of the pistons (22, 32). Thus, the number of the cylinder chambers increases by the number of the sets of the cylinder (21, 31) and the piston (22, 32).

In an eighth aspect of the invention related to the seventh aspect of the invention, the compression mechanism includes two sets of the cylinder (21, 31) and the piston (22, 32).

According to the eighth aspect of the invention, two sets of the cylinder (21, 31) and the piston (22, 32) are provided, and the sub-cylinder chamber (C2) is provided radially outside the end plate (22*c*, 32*c*) of each of the pistons (22, 32). Thus, two more cylinder chambers are provided as the two sets of the cylinder (21, 31) and the piston (22, 32) are provided.

Advantages of the Invention

According to the present invention, space radially outside the end plate, which is not generally used as the cylinder chamber, is also used as the cylinder chamber, i.e., one more cylinder chamber is provided. Thus, when the main cylinder chamber (C1) includes two cylinder chambers, the compression mechanism has three cylinder chambers, i.e., the two cylinder chambers and the sub-cylinder chamber (C2). When the main cylinder chamber (C1) includes three cylinder chambers, the compression mechanism has four cylinder chambers, i.e., the three cylinder chambers and the sub-cylinder chamber (C2).

The space radially outside the end plate is formed merely for allowing the end plate to revolve, and does not contribute to the compression of the fluid. According to the present invention, the space radially outside the end plate is used as the cylinder chamber, thereby increasing the number of the cylinder chambers without wasting the space. In increasing the number of the cylinder chambers, parts count and fabrication costs are not increased, the configuration is not complicated, and the compressor is not upsized. Thus, an eccentrically rotatable compression mechanism including a plurality of cylinder chambers can easily be put into practical use.

According to the second aspect of the invention, the main cylinder chamber (C1) includes three cylinder chambers, and the sub-cylinder chamber (C2) is additionally formed. That is, the compression mechanism has four cylinder chambers in total. Thus, the compression mechanism including the four cylinder chambers can be provided by using only a single set of the cylinder (21, 31) and the annular piston (22, 32), although it has not been provided unless two sets of compression mechanisms each having two cylinder chambers between a set of the cylinder (21, 31) and the annular piston (22, 32) are provided. This can surely prevent complication and upsizing of the mechanism.

According to the third aspect of the invention, fluid such as a refrigerant can be compressed using the four cylinder chambers, i.e., the innermost cylinder chamber (23*a*, 33*a*), the inner cylinder chamber (23*b*, 33*b*), and the outer cylinder chamber (23*c*, 33*c*) which are formed relative to the same plane, and the outermost cylinder chamber (23*d*, 33*d*) which is formed relative to a different plane. Use of the space radially outside the end plate as the outermost cylinder chamber (23*d*, 33*d*) can prevent the complication and upsizing of the mechanism.

According to the fourth aspect of the invention, the compression mechanism including the four cylinder chambers between a single set of the cylinder (21, 31) and the piston (22, 32) can be provided by using the blade (24, 34) having the swing bush (24*c*, 34*c*), the inner blade portion (B1), the first outer blade portion (B2), and the second outer blade portion (B3). In this case, the swing bush (24*c*, 34*c*), the inner blade portion (B1), the first outer blade portion (B2), and the second outer blade portion (B3) may be made of an integrated member, or separated members. In either case, the compression mechanism of a simple configuration can be put into practical use.

According to the fifth aspect of the invention, the first swing-permitting surface (n1) is formed in the outer peripheral surface of the inner piston portion (22*a*, 32*a*), and the second swing-permitting surface (n2) is formed in the outer peripheral surface of the end plate (22*c*, 32*c*). This can ensure smooth movement of the cylinder (21, 31), the piston (22, 32), and the blade (24, 34) during the operation of the compression mechanism, and the compression using the four cylinder chambers can surely be performed.

According to the sixth aspect of the invention, the fine gap is formed between the tip end of the inner blade portion (B1) and the first swing-permitting surface (n1), and the fine gap is formed between the tip end of the second outer blade portion (B3) and the second swing-permitting surface (n2) when the blade (24, 34) swings about the swing bush (24*c*, 34*c*). When the gaps are dimensioned on the order of microns so that the gaps are filled with an oil film formed by a lubricant supplied on the swing-permitting surfaces, leakage of the fluid from the discharge side to the suction side of the cylinder chamber can be prevented, and the compression mechanism can smoothly be operated. In addition, the tip end of the blade (24, 34) is not worn, and slide loss does not occur. When the swing bush (24*c*, 34*c*) is made of a member separated from the blade (24, 34), the fluid may leak between the swing bush and the blade. In the present invention, however, the swing bush (24*c*, 34*c*) is integrated with the blade (24, 34), and the leakage does not occur. In this configuration, the blade (24, 34) is made of an integrated member, and increase of the parts count can be prevented. In this case, the blade (24, 34) may be made of several members integrated with each other, or may be formed as an integrated member by cutting.

According to the seventh aspect of the invention, two or more sets of the cylinder (21, 31) and the piston (22, 32) are provided, and the sub-cylinder chamber (C2) is provided radially outside the end plate (22*c*, 32*c*) of each of the pistons (22, 32). Thus, the number of the cylinder chambers increases by the number of the sets of the cylinder (21, 31) and the piston (22, 32). Accordingly, the cylinder chambers can be increased more efficiently, and multistage compression can easily be performed.

According to the eighth aspect of the invention, two sets of the cylinder (21, 31) and the piston (22, 32) are provided, and the sub-cylinder chamber (C2) is provided radially outside the end plate (22*c*, 32*c*) of each of the pistons (22, 32). Thus, two more cylinder chambers are provided as the two sets of the cylinder (21, 31) and the piston (22, 32) are provided. In this configuration, when the sets of the cylinder (21, 31) and the piston (22, 32) are configured in the same manner, the phases of the corresponding cylinder chambers are shifted by 180° to cancel their moments. This can reduce pulsation, oscillation, or noise.

DESCRIPTION OF EMBODIMENTS

An embodiment of the present invention will be described in detail below with reference to the drawings.

Figure 1:
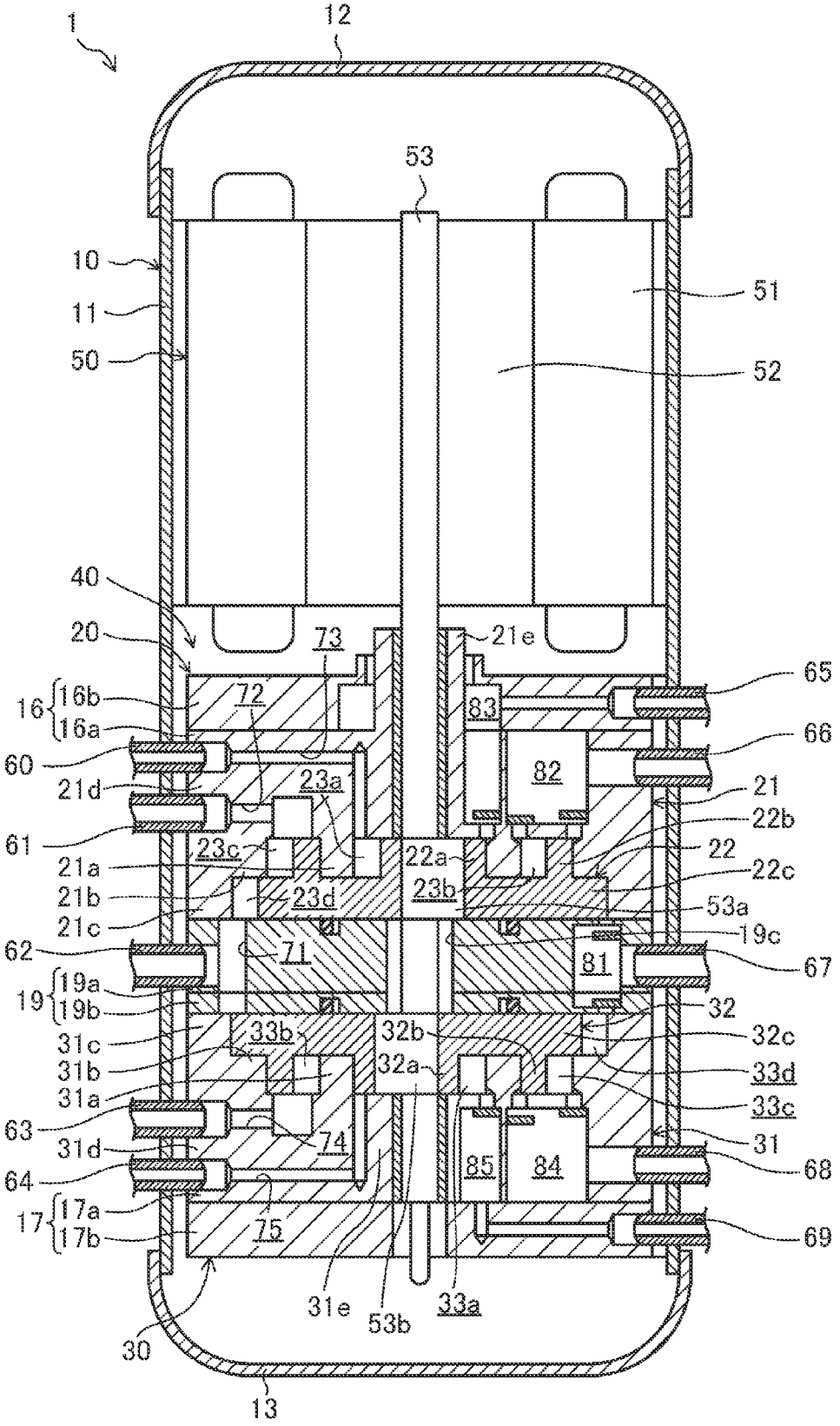
FIG. 1 is a vertical cross-sectional view of a compressor of an embodiment of the present invention.
Figure 2:
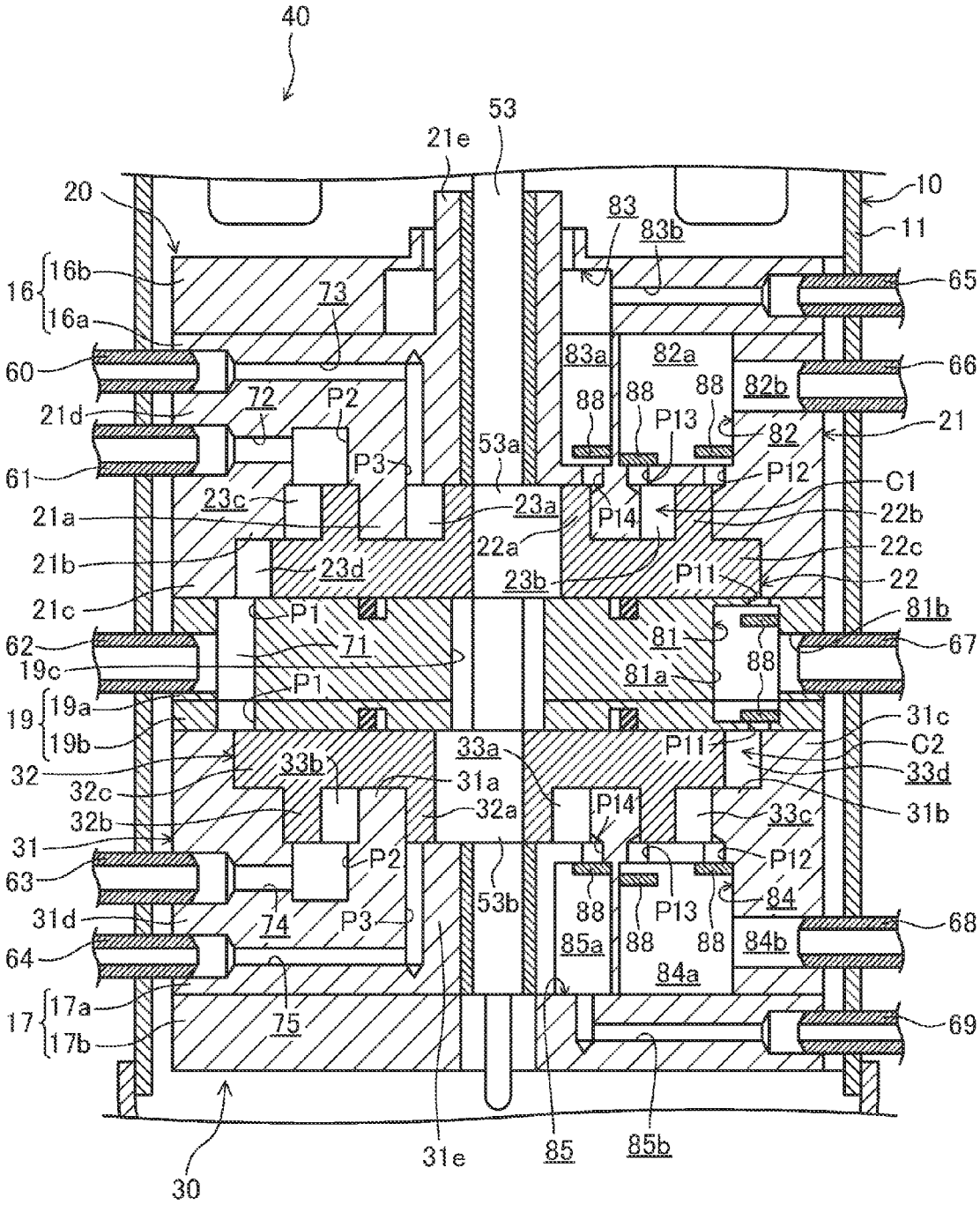
FIG. 2 is a partially enlarged view of FIG. 1.

A compressor (1) of the present embodiment is a rotary compressor, and includes, as shown in FIG. 1, a casing (10) containing a compression mechanism (40) including two compression mechanism units (a first compression mechanism unit (20) and a second compression mechanism unit (30)) stacked in an axial direction of a drive shaft (53), and an electric motor (50) as a drive mechanism. The compressor (1) is a hermetically sealed compressor. The compressor (1) is used, for example, to compress a refrigerant (working fluid) sucked from an evaporator of a refrigerant circuit of an air conditioner, and discharge the compressed refrigerant to a condenser.

The casing (10) includes a cylindrical barrel (11), an upper end plate (12) fixed to an upper end of the barrel (11), and a lower end plate (13) fixed to a lower end of the barrel (11). The barrel (11) is provided with suction pipes (60, . . . , 64) penetrating the barrel to introduce the refrigerant to annular cylinder chambers (23*a*, . . . , 23*d*, 33*a*, . . . , 33*d*) of the first compression mechanism unit (20) and the second compression mechanism unit (30) described in detail later, and discharge pipes (65, . . . , 69) penetrating the barrel to discharge the refrigerant compressed in the cylinder chambers (23*a*, . . . , 23*d*, 33*a*, . . . , 33*d*).

The electric motor (50) is arranged in the casing (10) above the compression mechanism (40), and includes a stator (51) and a rotor (52). The stator (51) is fixed to the barrel (11) of the casing (10). A drive shaft (53) is coupled to the rotor (52) so that the drive shaft and the rotor can integrally rotate. The drive shaft (53) extends downward from the rotor (52), and has a first eccentric part (53*a*) and a second eccentric part (53*b*) at a lower part thereof. The upper first eccentric part (53*a*) has a larger diameter than a main part of the drive shaft located above and below the first eccentric part (53*a*), and is eccentric to an axial center of the drive shaft (53) by a predetermined amount. The lower second eccentric part (53*b*) has the same diameter as the first eccentric part (53*a*), and is eccentric to the axial center of the drive shaft (53) by the same amount as the first eccentric part (53*a*). Phases of the first eccentric part (53*a*) and the second eccentric part (53*b*) are shifted by 180° relative to the axial center of the drive shaft (53).

The first compression mechanism unit (20) and the second compression mechanism unit (30) are vertically stacked, and provided between a front head (16) and a rear head (17) fixed to the casing (10). The first compression mechanism unit (20) is arranged closer to the electric motor (50) (an upper side in FIG. 1), and the second compression mechanism unit (30) is arranged closer to a bottom of the casing (10) (a lower side in FIG. 1). In the present embodiment, the front head (16) includes a body (16*a*) and a lid (16*b*), and the rear head (17) also includes a body (17*a*) and a lid (17*b*). A middle plate (19) is provided between the front head (16) and the rear head (17).

The middle plate (19) is shared by the first compression mechanism unit (20) and the second compression mechanism unit (30). The middle plate (19) includes two members (19*a*, 19*b*) arranged in the axial direction of the drive shaft (53). Specifically, the middle plate (19) includes a body (19*a*) closer to the first compression mechanism unit (20), and a lid (19*b*) attached to a lower surface of the body (19*a*). A through hole (19*c*) through which the drive shaft (53) passes is formed in a center of the middle plate (19). The through hole (19*c*) has an inner diameter slightly larger than the diameters of the first eccentric part (53*a*) and the second eccentric part (53*b*) of the drive shaft.

As shown in FIGS. 2-5, the first compression mechanism unit (20) includes a first cylinder (21) fixed to the barrel (11) of the casing (10), a first piston (22) which is attached to the first eccentric part (53*a*) of the drive shaft (53), and eccentrically rotates relative to the first cylinder (21), and a first blade (24) which divides four cylinder chambers (23*a*, 23*b*, 23*c*, 23*d*) formed between the first cylinder (21) and the first piston (22) into high pressure chambers (23*a*H, 23*b*H, 23*c*H, 23*d*H) and low pressure chambers (23*a*L, 23*b*L, 23*c*L, 23*d*L).

The second compression mechanism unit (30) is arranged upside down relative to the first compression mechanism unit (20). The second compression mechanism unit (30) includes a second cylinder (31) fixed to the barrel (11) of the casing (10), a second piston (32) which is attached to the second eccentric part (53*b*) of the drive shaft (53), and eccentrically rotates relative to the second cylinder (31), and a second blade (34) which divides four cylinders (33*a*, 33*b*, 33*c*, 33*d*) formed between the second cylinder (31) and the second piston (32) into high pressure chambers (33*a*H, 33*b*H, 33*c*H, 33*d*H) and low pressure chambers (33*a*L, 33*b*L, 33*c*L, 33*d*L).

In the present embodiment, the body (16*a*) of the front head (16) constitutes the first cylinder (21), and the body (17*a*) of the rear head (17) constitutes the second cylinder (31). In the present embodiment, the first cylinder (21) and the second cylinder (31) are fixed, and the first piston (22) and the second piston (32) are movable. The first piston (22) is configured to eccentrically rotate relative to the first cylinder (21), and the second piston (32) is configured to eccentrically rotate relative to the second cylinder (31).

The first cylinder (21) includes an inner cylinder portion (21*a*) and an outer cylinder portion (21*b*) which are concentric with the drive shaft (53), and form annular space (cylinder space), an outermost cylinder portion (21*c*) extending downward from an outer peripheral portion of the outer cylinder portion (21*b*), and a cylinder end plate (21*d*) connecting upper ends of the inner cylinder portion (21*a*) and the outer cylinder portion (21*b*). The inner cylinder portion (21*a*) is in the shape of an annular ring partially cut away, i.e., in the shape of C (see FIG. 3(A)). A slide groove (21*g*) is formed in the cut part of the inner cylinder portion (21*a*).

The second cylinder (31) includes an inner cylinder portion (31*a*) and an outer cylinder portion (31*b*) which are concentric with the drive shaft (53), and form annular space (cylinder space), an outermost cylinder portion (31*c*) extending upward from an outer peripheral portion of the outer cylinder portion (31*b*), and a cylinder end plate (31*d*) connecting lower ends of the inner cylinder portion (31*a*) and the outer cylinder portion (31*b*). The inner cylinder portion (31*a*) is in the shape of an annular ring partially cut away, i.e., in the shape of C (see FIG. 3(A)). A slide groove (31*g*) is formed in the cut part of the inner cylinder portion (31*a*).

The first piston (22) includes an inner piston portion (22*a*) which fits on the first eccentric part (53*a*) and is concentric with the first eccentric part (53*a*), an outer piston portion (an annular piston portion) (22*b*) which is arranged in the annular space outside the inner piston portion (22*a*) to be concentric with the inner piston portion (22*a*), and a piston end plate (22*c*) which connects lower ends of the two piston portions (22*a*, 22*b*), and has an outer peripheral surface concentric with the inner piston portion (22*a*) and the outer piston portion (22*b*).

The inner piston portion (22*a*) is provided with a notch (n1) formed in an outer peripheral surface thereof, and the outer piston portion (22*b*) is in the shape of an annular ring partially cut away, i.e., in the shape of C (see FIG. 3(A)). The piston end plate (22*c*) is provided with a notch (n2) formed in an outer peripheral surface thereof (see FIG. 3(B)). The piston end plate (22*c*) is configured to close three cylinder chambers (cylinder space) (23*a*, 23*b*, 23*c*) constituting a main cylinder chamber (C1) of the present invention. The first cylinder (21) has end plate storage space (a sub-cylinder chamber) (C2) for storing the piston end plate (22*c*) of the first piston (22) in an eccentrically rotatable manner.

The second piston (32) includes an inner piston portion (32*a*) which fits on the second eccentric part (53*b*) and is concentric with the second eccentric part (53*b*), an inner outer piston portion (an annular piston portion) (32*b*) which is arranged in the annular space outside the piston portion (32*a*) to be concentric with the inner piston portion (32*a*), and a piston end plate (32*c*) which connects upper ends of the two piston portions (32*a*, 32*b*), and has an outer peripheral surface concentric with the inner piston portion (32*a*) and the outer piston portion (32*b*).

The inner piston portion (32*a*) is provided with a notch (n1) formed in an outer peripheral surface thereof, and the outer piston portion (32*b*) is in the shape of an annular ring partially cut away, i.e., in the shape of C (see FIG. 3(A)). The piston end plate (32*c*) is provided with a notch (n2) formed in an outer peripheral surface thereof (see FIG. 3(B)). The piston end plate (32*c*) is configured to close three cylinder chambers (cylinder space) (33*a*, 33*b*, 23*c*) constituting the main cylinder chamber (C1) of the present invention. The second cylinder (31) has end plate storage space (a sub-cylinder chamber) (C2) for storing the piston end plate (32*c*) of the second piston (32) in an eccentrically rotatable manner.

The first cylinder (21) constituting the body (16*a*) of the front head (16) and the second cylinder (31) constituting the body (17*a*) of the rear head (17) include bearings (21*e*, 31*e*) for supporting the drive shaft (53), respectively. In the compressor (1) of the present embodiment, the drive shaft (53) vertically penetrates the first compression mechanism unit (20) and the second compression mechanism unit (30), and a main part of the drive shaft extending above and below the first eccentric part (53*a*) and the second eccentric part (53*b*) in the axial direction is held by the casing (10) through the bearings (21*e*, 31*e*).

Internal configuration of the first and second compression mechanism units (20, 30) will be described below. The first and second compression mechanism units (20, 30) have substantially the same configuration except that axial lengths of the outer piston portions (22, 32) are different, and axial lengths of the corresponding cylinders (21, 31) are different to vary capacities of the cylinders. Thus, the first compression mechanism unit (20) will be described as a representative example.

The first blade (24) includes a long portion (24*a*) and a short portion (24*b*) which are plate-shaped and have a certain thickness, and a pair of swing bushes (24*c*) each having a substantially semicircular cross section. The three portions are integrated.

Specifically, the first blade (24) includes swing bushes (24*c*) which are swingably connected to the outer piston portion (22*b*), an inner blade portion (B1) which is located inside the swing bushes (24*c*) in a radial direction of the compression mechanism (40), and divides an innermost cylinder chamber (23*a*) and an inner cylinder chamber (23*b*) described later into a suction side chamber and a discharge side chamber, a first outer blade portion (B2) which is located outside the swing bushes (24*c*) in the radial direction, and divides an outer cylinder chamber (23*c*) described later into a suction side chamber and a discharge side chamber, and a second outer blade portion (B3) which is located outside the swing bushes (24*c*) in the radial direction, and divides an outermost cylinder chamber (23*d*) described later into a suction side chamber and a discharge side chamber. The swing bushes (24*c*), the inner blade portion (B1), and the first outer blade portion (B2) constitute the long portion (24*a*), and the second outer blade portion (B3) constitutes the short portion (24*b*). A tip end of the inner blade portion (B1) faces an outer peripheral surface of the inner piston portion (22*a*) from outside in the radial direction, and a tip end of the second outer blade portion (B3) faces an outer peripheral surface of the piston end plate (22*c*) from outside in the radial direction.

The long portion (24*a*) extends in the radial direction between the cylinder end plate (21*d*) and the piston end plate (22*c*), and an outer end thereof is slidably held in a groove (a slide groove) (21*f*) formed in the outer cylinder portion (21*b*) to be slidable in the radial direction (in a direction of a surface of the blade). Part of the long portion (24*a*) radially inside the swing bushes (24*c*) (the inner blade portion (B1)) is slidably inserted in the slide groove (21*g*) formed in the cut part of the inner cylinder portion (21*a*), and an inner end thereof faces the notch (n1) of the inner piston portion (22*a*) with a fine gap on the order of microns interposed therebetween.

Figure 6:
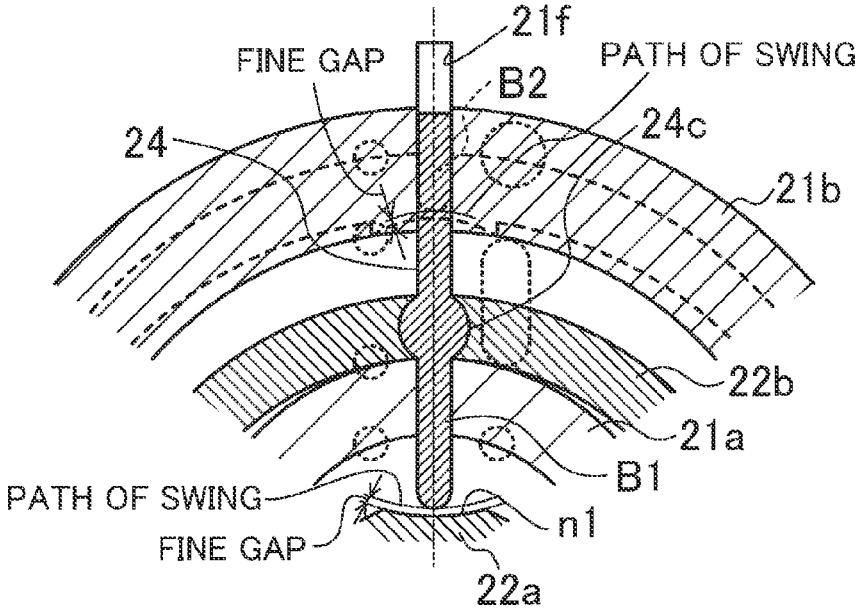
FIG. 6 is a partially enlarged view of the compression mechanism unit of the embodiment of the present invention.

In FIG. 6, the notch (n1) constitutes a first swing-permitting surface which permits relative swing of the inner blade portion (B1) about the swing bushes (24*c*). The first swing-permitting surface (n1) is formed based on a segment of a circle having a diameter slightly larger than a path of the relative swing of the inner blade portion (B1) about the swing bushes (24*c*) so that a fine gap is formed between the path of the tip end of the swinging inner blade portion (B1) and the first swing-permitting surface (n1). The fine gap shown in FIG. 6 is exaggerated.

The short portion (24*b*) radially extends between the long portion (24*a*) and the middle plate (19), and is held in a groove (slide groove) (21*f*) formed in the outermost cylinder portion (21*c*) to be slidable in the radial direction. An inner end of the short portion (24*b*) faces the notch (n2) of the piston end plate (22*c*) with a fine gap on the order of microns interposed therebetween.

The notch (n2) constitutes a second swing-permitting surface which permits relative swing of the second outer blade portion (B3) about the swing bushes (24*c*). The second swing-permitting surface (n2) is formed based on a segment of a circle having a diameter slightly smaller than a path of the relative swing of the second outer blade portion (B3) about the swing bushes (24*c*) so that a fine gap is formed between the path of the tip end of the swinging second outer blade portion (B3) and the second swing-permitting surface (n2). The fine gap shown in FIG. 6 is exaggerated.

The pair of swing bushes (24*c*) bulge from both sides of a radial center of the long portion (24*a*). An outer peripheral surface of the pair of swing bushes (24*c*) constitutes part of an outer peripheral surface of a cylinder having a predetermined radius. The pair of swing bushes (24*c*) are swingably contained in bush grooves (c1, c2) formed in a cut part of the outer piston portion (22*b*). The pair of swing bushes (24*c*) are configured in such a manner that the outer piston portion (22*b*) swings relative to the first blade (24).

In this configuration, the first piston (22) swings about a center of the pair of swing bushes (24*c*) relative to the first blade (24) as the first eccentric part (53*a*) eccentrically rotates, and moves back and forth in a longitudinal direction (surface direction) of the first blade (24) as the first blade (24) slides in the longitudinal direction relative to the groove (21*f*) and the slide groove (21*g*) of the inner cylinder portion (21*a*).

As described above, the main cylinder chamber (C1) includes the innermost cylinder chamber (23*a*), the inner cylinder chamber (23*b*), and the outer cylinder chamber (23*c*) which are arranged from inside to outside in the radial direction, and the sub-cylinder chamber (C2) forms the outermost cylinder chamber (23*d*) located radially outside the outer cylinder chamber (23*c*). The cylinder chambers are configured as described below.

The inner piston portion (22*a*) is arranged radially inside the inner cylinder portion (21*a*), and the outer piston portion (22*b*) is arranged between the inner cylinder portion (21*a*) and the outer cylinder portion (21*b*). The innermost cylinder chamber (23*a*) is formed between the inner piston portion (22*a*) which slidably fits on the first eccentric part (53*a*) and the inner cylinder portion (21*a*) whose inner peripheral surface has a larger diameter than an outer peripheral surface of the inner piston portion (22*a*). Annular space is formed between an outer peripheral surface of the inner cylinder portion (21*a*) and an inner peripheral surface of the outer cylinder portion (21*b*) which are concentric with each other. The annular space is divided into inner and outer cylinder chambers (23*b*, 23*c*) by the outer piston portion (22*b*) arranged in the annular space. Specifically, the inner cylinder chamber (23*b*) is formed between the outer peripheral surface of the inner cylinder portion (21*a*) and an inner peripheral surface of the outer piston portion (22*b*), and the outer cylinder chamber (23*c*) is formed between an outer peripheral surface of the outer piston portion (22*b*) and the inner peripheral surface of the outer cylinder portion (21*b*). The piston end plate (22*c*) is provided in such a manner that an upper surface thereof faces the three cylinder chambers (23*a*, 23*b*, 23*c*), and a lower surface thereof faces an upper surface of the middle plate (19) (an upper surface of the body (19*a*)), and an outer peripheral surface thereof faces an inner peripheral surface of the outermost cylinder portion (21*c*). Thus, the outermost cylinder chamber (23*d*) is formed between an outer peripheral surface of the piston end plate (22*c*) and the outermost cylinder portion (21*c*).

Thus, the compressor (1) has the first compression mechanism unit (20) and the second compression mechanism unit (30), each having four cylinder chambers (23*a*, 23*d*, 33*a*, . . . , 33*d*).

In each of the first compression mechanism unit (20) and the second compression mechanism unit (30), when the outer peripheral surface of the inner piston portion (22*a*, 32*a*) and the inner peripheral surface of the inner cylinder portion (21*a*, 31*a*) contact substantially at a single point (a first contact point) (in a strict sense, a gap on the order of microns exists between them, but leakage of the refrigerant through, the gap is negligible), the outer peripheral surface of the inner cylinder portion (21*a*, 31*a*) and the inner peripheral surface of the outer piston portion (22*b*, 32*b*) contact substantially at a single point (a second contact point) where a phase is shifted by 180° from the first contact point. In addition, at a phase shifted by 180° from the second contact point (at the same phase as the first contact point), the outer peripheral surface of the outer piston portion (22*b*, 32*b*) and the inner peripheral surface of the outer cylinder portion (21*b*, 31*b*) contact substantially at a single point (a third contact point), and the outer peripheral surface of the piston end plate (22*c*, 32*c*) and the inner peripheral surface of the outermost cylinder portion (21*c*, 31*c*) contact substantially at a single point (a fourth contact point).

In this configuration, when the drive shaft (53) rotates, the first piston (22) swings about the center of the swing bushes (24*c*), and moves back and forth in the longitudinal direction of the first blade (24) together with the first blade (24). When the drive shaft (53) rotates, the second piston (32) swings about the center of the swing bushes (34*c*), and moves back and forth in the longitudinal direction of the second blade (34) together with the second blade (34).

According to the swing, the contact points between the first piston (22) and the first cylinder (21) (the first to fourth contact points) sequentially change in the order of FIGS. 7(A)-(D), and FIGS. 8(A)-(D). The contact points between the second piston (32) and the second cylinder (31) (the first to fourth contact points) are shifted by 180° about the axial center of the drive shaft (53) from the corresponding contact points between the first piston (22) and the first cylinder (21). Specifically, when viewed from the top of the drive shaft (53), when the first compression mechanism unit (20) is operated in the state of FIG. 7(A) and FIG. 8(A), the second compression mechanism unit (30) is operated in the state of FIG. 7(C) and FIG. 8(C).

In the present embodiment, the compression mechanism (40) is configured to function as a four-stage compression mechanism in which the refrigerant is compressed in four stages in eight cylinder chambers (23*a*, . . . , 23*d*, 33*a*, . . . , 33*d*).

Specifically, the outermost cylinder chambers (23*d*, 33*d*) of the first compression mechanism unit (20) and the second compression mechanism unit (30) form cylinder chambers of a first stage compression mechanism. The outer cylinder chamber (23*c*) and the inner cylinder chamber (23*b*) of the first compression mechanism unit (20) form cylinder chambers of a second stage compression mechanism, and the outer cylinder chamber (33*c*) and the inner cylinder chamber (33*b*) of the second compression mechanism unit (30) form cylinder chambers of a third stage compression mechanism. The innermost cylinder chambers (23*a*, 33*a*) of the first compression mechanism unit (20) and the second compression mechanism unit (30) form cylinder chambers of a fourth stage compression mechanism.

Thus, the compressor (1) of the present embodiment is a rotary compressor including a cylinder (21, 31) having annular cylinder space, an annular piston (22, 32) arranged to be eccentric to the cylinder (21, 31), and a compression mechanism (20, 30) in which a plurality of cylinder chambers (23*a*, . . . , 23*d*, 33*a*, . . . , 33*d*) are formed between the cylinder (21, 31) and the piston (22, 32), and a suction port and a discharge port are formed in each of the cylinder chambers (23*a*, . . . , 23*d*, 33*a*, . . . , 33*d*) as described below. Four cylinder chambers (23*a*, . . . , 23*d*, 33*a*, . . . , 33*d*) are formed between a pair of the cylinder (21, 31) and the piston (22, 32), and the cylinder chambers (23*a*, . . . , 23*d*, 33*a*, . . . , 33*d*) form a cylinder chamber (23*d*, 33*d*) of a first stage compression mechanism which performs first stage compression of a low pressure refrigerant, a cylinder chamber (23*c*, 23*b*) of a second stage compression mechanism which performs second stage compression of a refrigerant discharged from the first stage compression mechanism, a cylinder chamber (33*c*, 33*b*) of a third stage compression mechanism which performs third stage compression of a refrigerant discharged from the second stage compression mechanism, and a cylinder chamber (23*a*, 33*a*) of a fourth stage compression mechanism which performs fourth stage compression of a refrigerant discharged from the third stage compression mechanism. The refrigerant is cooled by a cooling mechanism between the first and second stage compression mechanisms, between the second and third stage compression mechanisms, and between the third and fourth stage compression mechanisms.

The compression mechanism (40) is provided with suction ports (P1, P2, P3) and discharge ports (P11, P12, P13, P14) of the cylinder chambers (23*a*, . . . , 23*d*, 33*a*, . . . , 33*d*).

Specifically, a suction port (P1) and a discharge port (P11) of the outermost cylinder chamber (23*d*, 33*d*) of the first compression mechanism unit (20) and the second compression mechanism unit (30) are formed in the middle plate (19).

A suction port (P2) shared by the outer cylinder chamber (23*c*) and the inner cylinder chamber (23*b*) of the first compression mechanism unit (20), and a suction port (P3) of the innermost cylinder chamber (23*a*) of the first compression mechanism unit (20) are formed in the front head (16). The suction port (P2) may be provided separately for the outer cylinder chamber (23*c*) and the inner cylinder chamber (23*b*) of the first compression mechanism unit (20). A discharge port (P12) of the outer cylinder chamber (23*c*) of first compression mechanism unit (20), a discharge port (P13) of the inner cylinder chamber (23*b*) of the first compression mechanism unit (20), and a discharge port (P14) of the innermost cylinder chamber (23*a*) of the first compression mechanism unit (20) are formed in the front head (16).

A suction port (P2) shared by the outer cylinder chamber (33*c*) and the inner cylinder chamber (33*b*) of the second compression mechanism unit (30), and a suction port (P3) of the innermost cylinder chamber (33*a*) of the second compression mechanism unit (30) are formed in the rear head (17).

The suction port (P2) may be provided separately for the outer cylinder chamber (33*c*) and the inner cylinder chamber (33*b*) of the second compression mechanism unit (30). A discharge port (P12) of the outer cylinder chamber (33*c*) of the second compression mechanism unit (30), a discharge port (P13) of the inner cylinder chamber (33*b*) of the second compression mechanism unit (30), and a discharge port (P14) of the innermost cylinder chamber (33*a*) of the second compression mechanism unit (30) are formed in the rear head (17).

The compression mechanism (40) is provided with suction paths (71, . . . , 75) which are connected to the suction ports (P1, P2, P3) of the cylinder chambers (23*a*, . . . , 23*d*, 33*a*, . . . , 33*d*), and through which the refrigerant is sucked into the cylinder chambers (23*a*, . . . , 23*d*, 33*a*, . . . , 33*d*).

Specifically, a suction path (71) communicating with the suction ports (P1, P1) of the outermost cylinder chambers (23*d*, 33*d*) of the first compression mechanism unit (20) and the second compression mechanism unit (30) is formed in the middle plate (19).

A suction path (72) communicating with the suction port (P2) shared by the outer cylinder chamber (23*c*) and the inner cylinder chamber (23*b*) of the first compression mechanism unit (20), and a suction path (73) communicating with the suction port (P3) of the innermost cylinder chamber (23*a*) of the first compression mechanism unit (20) are formed in the front head (16).

A suction path (74) communicating with the suction port (P2) shared by the outer cylinder chamber (33*c*) and the inner cylinder chamber (33*b*) of the second compression mechanism unit (30), and a suction path (75) introducing the refrigerant to the suction port (P3) of the innermost cylinder chamber (33*a*) of the second compression mechanism unit (30) are formed in the rear head (17).

A suction pipe (60, . . . , 64) introducing the refrigerant from the outside to the inside of the casing (10) is connected to each of the suction paths (71, . . . , 75).

The compression mechanism (40) is provided with discharge rooms (81, . . . , 85) which are connected to the discharge ports (P11, P12, P13, P14) of the cylinder chambers (23*a*, . . . , 23*d*, 33*a*, . . . , 33*d*), and into which the refrigerant is discharged from the cylinder chambers (23*a*, . . . , 23*d*, 33*a*, . . . , 33*d*).

Specifically, a discharge room (81) communicating with the discharge ports (P11, P11) of the outermost cylinder chambers (23*d*, 33*d*) of the first compression mechanism unit (20) and the second compression mechanism unit (30) is formed in the middle plate (19).

A discharge room (82) communicating with the discharge ports (P12, P13) of the outer cylinder chamber (23*c*) and the inner cylinder chamber (23*b*) of the first compression mechanism unit (20), and a discharge room (83) communicating with the discharge port (P14) of the innermost cylinder chamber (23*a*) of the first compression mechanism unit (20) are formed in the front head (16). The discharge room (82) may be provided separately for the discharge ports (P12, P13).

A discharge room (84) into which the refrigerant is discharged from the outer cylinder chamber (33*c*) and the inner cylinder chamber (33*b*) of the second compression mechanism unit (30), and a discharge room (85) into which the refrigerant is discharged from the innermost cylinder chamber (33*a*) of the second compression mechanism unit (30) are formed in the rear head (17). The discharge room (84) may be provided separately for the discharge ports (P12, P13).

Each of the discharge rooms (81, . . . , 85) is formed by a muffler room (81*a*, . . . , 85*a*) for reducing pulsation, and a passage (81*b*, . . . , 85*b*) communicating with the muffler room (81*a*, . . . , 85*a*).

A discharge valve (88) for opening and closing the discharge port (P11, . . . , P14) is provided in the muffler room (81*a*, . . . , 85*a*) of each of the discharge rooms (81, . . . , 85). A discharge pipe (65, . . . , 69) through which the discharged refrigerant is introduced to the outside of the casing (10) is connected to the passage (81*b*, . . . , 85*b*) of each of the discharge rooms (81, . . . , 85).

The discharge room (81) is formed to extend from the body (19*a*) to the lid (19*b*) of the middle plate (19). Specifically, the muffler room (81*a*) of the discharge room (81) is formed to extend between the two members of the middle plate (19), i.e., the body (19*a*) and the lid (19*b*). The muffler room (83*a*) of the discharge room (83) is formed to extend from the body (16*a*) to the lid (16*b*) of the front head (16), and the muffler room (82*a*) of the discharge room (82) is formed closer to the body (16*a*), and can be closed by the lid (16*b*). The muffler room (84*a*, 85*a*) of the discharge room (84, 85) is formed closer to the body (17*a*) of the rear head (17), and can be closed by the lid (17*b*).

—Working Mechanism—

A working mechanism of the compressor (1) will be described below. The first and second compression mechanism units (20, 30) are operated with their phases shifted by 180°.

When the electric motor (50) is activated, in the first compression mechanism unit (20), rotation of the rotor (52) is transmitted to the first piston (22) through the first eccentric part (53*a*) of the drive shaft (53), and the first piston (22) swings about the center of the swing bushes (24*c*), and moves back and forth in the longitudinal direction of the first blade (24) together with the first blade (24). Thus, the first piston (22) revolves while swinging relative to the first cylinder (21), and predetermined compression is performed in the four cylinder chambers (23*a*, 23*b*, 23*c*, 23*d*) of the first compression mechanism unit (20).

In this state, a fine gap on the order of microns is formed between a tip end of the inner blade portion (B1) and a surface of the notch (n1) of the inner piston portion (22*a*), i.e., the inner blade portion (B1) and the inner piston portion (22*a*) are not in contact with each other. A fine gap on the order of microns is also formed between a tip end of the second outer blade portion (B3) and a surface of the notch (n2) of the piston end plate (22*c*), i.e., the second outer blade portion (B3) and the piston end plate (22*c*) are not in contact with each other. An oil film of a lubricant is formed in each of the fine gaps. Thus, leakage of the refrigerant from a high pressure side to a low pressure side in the cylinder chamber (C1, C2) is substantially negligible.

Figure 7:
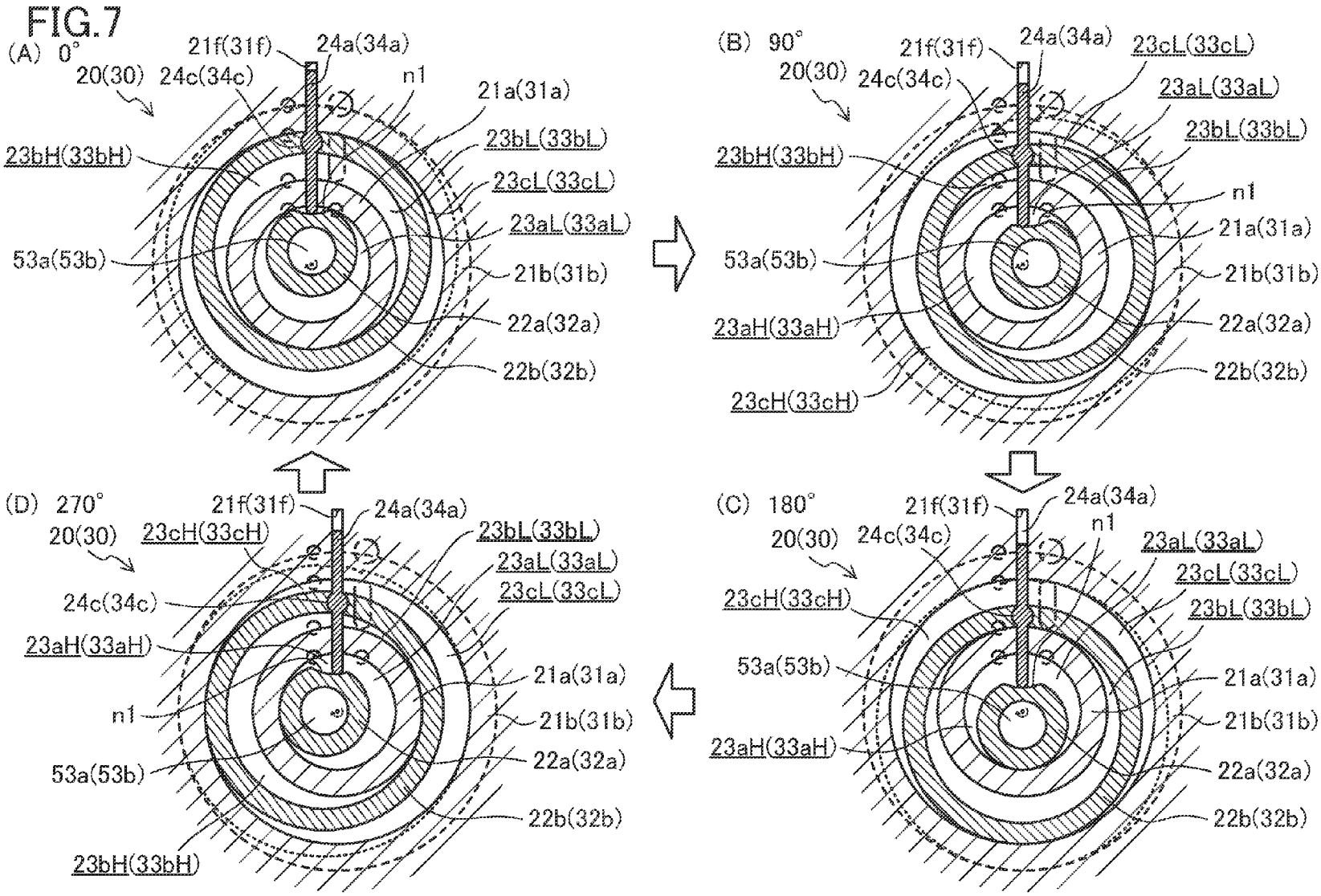
FIGS. 7(A)-7(D) show how the compression mechanism unit of the embodiment of the present invention is operated.

In the innermost cylinder chamber (23*a*) and the outer cylinder chamber (23*c*), a capacity of a low pressure chamber (23*a*L, 23*c*L) increases as the drive shaft (53) in the state of FIG. 7(A) rotates clockwise to the state of FIGS. 7(B)-7(D), and the refrigerant is sucked into the low pressure chamber (23*a*L, 23*c*L) through the suction port (P3, P2). When the drive shaft (53) has made a single rotation to return to the state of FIG. 7(A), the suction of the refrigerant to the low pressure chamber (23*a*L, 23*c*L) is finished. Then, the low pressure chamber (23*a*L, 23*c*L) is turned to be a high pressure chamber (23*a*H, 23*c*H) in which the refrigerant is compressed, and a new low pressure chamber (23*a*L, 23*c*L) separated by the first blade (24) is formed. When the drive shaft (53) further rotates, the suction of the refrigerant to the low pressure chamber (23*a*L, 23*c*L) is repeated, and a capacity of the high pressure chamber (23*a*H, 23*c*H) is reduced, thereby compressing the refrigerant in the high pressure chamber (23*a*H, 23*c*H). When a pressure in the high pressure chamber (23*a*H, 23*c*H) reaches a predetermined value, and a pressure difference between the high pressure chamber (23*a*H, 23*c*H) and the discharge room (83, 82) reaches a set value, the discharge valve (88, 88) is opened by the pressure of the refrigerant in the high pressure chamber (23*a*H, 23*c*H), and the refrigerant flows from the discharge room (83, 82) to the outside of the casing (10) through the discharge pipe (65, 66).

Figure 8:
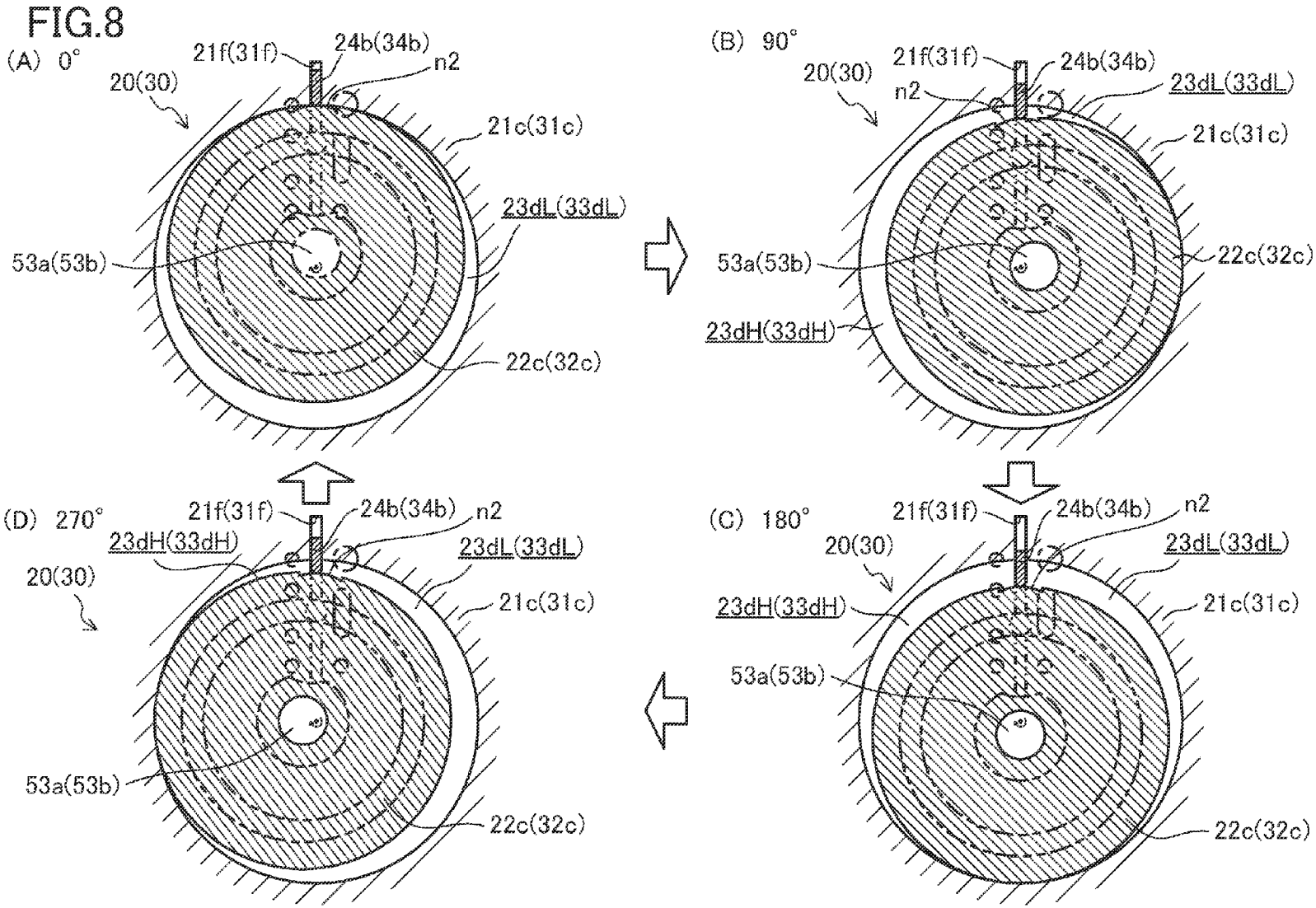
FIGS. 8(A)-8(D) show how the compression mechanism unit of the embodiment of the present invention is operated.

In the outermost cylinder chamber (23*d*), a capacity of a low pressure chamber (23*d*L) increases as the drive shaft (53) in the state of FIG. 8(A) rotates clockwise to the state of FIGS. 8(B)-8(D), and the refrigerant is sucked into the low pressure chamber (23*d*L) through the suction port (P1). When the drive shaft (53) has made a single rotation to return to the state of FIG. 8(A), the suction of the refrigerant to the low pressure chamber (23*d*L) is finished. Then, the low pressure chamber (23*d*L) is turned to be a high pressure chamber (23*d*H) in which the refrigerant is compressed, and a new low pressure chamber (23*d*L) separated by the first blade (24) is formed. When the drive shaft (53) further rotates, the suction of the refrigerant to the low pressure chamber (23*d*L) is repeated, and a capacity of the high pressure chamber (23*d*H) is reduced, thereby compressing the refrigerant in the high pressure chamber (23*d*H). When a pressure in the high pressure chamber (23*d*H) reaches a predetermined value, and a pressure difference between the high pressure chamber (23*d*H) and the discharge room (81) reaches a set value, the discharge valve (88) is opened by the pressure of the refrigerant in the high pressure chamber (23*d*H), and the refrigerant flows from the discharge room (81) to the outside of the casing (10) through the discharge pipe (67).

In the inner cylinder chamber (23*b*), a capacity of a low pressure chamber (23*b*L) increases as the drive shaft (53) in the state of FIG. 7(C) rotates clockwise to the state of FIGS. 7(D)-7(B), and the refrigerant is sucked into the low pressure chamber (23*b*L) through the suction port (P2). When the drive shaft (53) has made a single rotation to return to the state of FIG. 7(C), the suction of the refrigerant to the low pressure chamber (23*b*L) is finished. Then, the low pressure chamber (23*b*L) is turned to be a high pressure chamber (23*b*H) in which the refrigerant is compressed, and a new low pressure chamber (23*b*L) separated by the first blade (24) is formed. When the drive shaft (53) further rotates, the suction of the refrigerant to the low pressure chamber (23*b*L) is repeated, and a capacity of the high pressure chamber (23*b*H) is reduced, thereby compressing the refrigerant in the high pressure chamber (23*b*H). When a pressure in the high pressure chamber (23*b*B) reaches a predetermined value, and a pressure difference between the high pressure chamber (23*b*H) and the discharge room (82) reaches a set value, the discharge valve (88) is opened by the pressure of the refrigerant in the high pressure chamber (23*b*H), and the refrigerant flows from the discharge room (82) to the outside of the casing (10) through the discharge pipe (66).

Between the outer cylinder chamber (23*c*) and the inner cylinder chamber (23*b*), when the suction of the refrigerant is started and when the discharge of the refrigerant is started are different by approximately 180°. This can reduce discharge pulsation, thereby reducing oscillation and noise.

In the second compression mechanism unit (30), the rotation of the rotor (52) is transmitted to the second piston (32) through the second eccentric part (53*b*) of the drive shaft (53), and the second piston (32) swings about the center of the swing bushes (34*c*), and moves back and forth in the longitudinal direction of the second blade (34) together with the second blade (34). Thus, the second piston (32) revolves while swinging relative to the second cylinder (31), and predetermined compression is performed in the four cylinder chambers (33*a*, 33*b*, 33*c*, 33*d*) of the second compression mechanism unit (30).

The compression in the second compression mechanism unit (30) is substantially the same as the compression in the first compression mechanism unit (20), and the refrigerant is compressed in the cylinder chambers (33*a*, 33*b*, 33*c*, 33*d*). In each cylinder chamber (33*a*, 33*b*, 33*c*, 33*d*), when the pressure in the high pressure chamber (33*a*H, 33*b*H, 33*c*H, 33*d*H) reaches a predetermined value, and the pressure difference between the high pressure chamber and the discharge room (85, 84, 84, 81) reaches a set value, the discharge valve (88, 88, 88, 88) is opened by the pressure of the refrigerant in the high pressure chamber (33*a*H, 33*b*H, 33*c*H, 33*d*H), and the refrigerant flows from the discharge room (85, 84, 84, 81) to the outside of the casing (10) through the discharge pipe (69, 68, 68, 67).

When the compression mechanism (40) is operated, the refrigerant is sucked into and compressed in the outermost cylinder chamber (23*d*) of the first compression mechanism unit (20) and the outermost cylinder chamber (33*d*) of the second compression mechanism unit (30), which are the cylinder chambers of the first stage compression mechanism, through the suction pipe (62), and is discharged from the cylinder chambers of the first stage compression mechanism through the discharge pipe (67). The refrigerant discharged from the cylinder chambers of the first stage compression mechanism is cooled, sucked into the outer cylinder chamber (23*c*) and the inner cylinder chamber (23*b*) of the first compression mechanism unit (20), which are the cylinder chambers of the second stage compression mechanism, through the suction pipe (61) to be further compressed, and then discharged from the cylinder chambers of the second stage compression mechanism through the discharge pipe (66). The refrigerant discharged from the cylinder chambers of the second stage compression mechanism is cooled, sucked into the outer cylinder chamber (33*c*) and the inner cylinder chamber (33*b*) of the second compression mechanism unit (30), which are the cylinder chambers of the third stage compression mechanism, through the suction pipe (63) to be further compressed, and then discharged from the cylinder chambers of the third stage compression mechanism through the discharge pipe (68). The refrigerant discharged from the cylinder chambers of the third stage compression mechanism is cooled, sucked into the innermost cylinder chamber (23*a*) of the first compression mechanism unit (20) and the innermost cylinder chamber (33*a*) of the second compression mechanism unit (30), which are the cylinder chambers of the fourth stage compression mechanism, through the suction pipe (60, 64) to be further compressed, and then discharged from the cylinder chambers of the fourth stage compression mechanism through the discharge pipe (65, 69).

The refrigerant discharged from the cylinder chambers of the fourth stage compression mechanism sequentially flows through a radiator, an expansion mechanism, and an evaporator of a refrigerant circuit which is not shown, and is sucked into the compressor (1) again. Then, a compression stroke in the compressor (1), a heat radiation stroke in the radiator, an expansion stroke in the expansion mechanism, and an evaporation stroke in the evaporator are sequentially repeated to perform a refrigeration cycle.

Advantages of Embodiment

According to the present embodiment, space radially outside the piston end plate (22*c*, 32*c*), which is not generally used as the cylinder chamber, is also used as the cylinder chamber (C2). Thus, one more cylinder chamber is provided.

Since the main cylinder chamber (C1) includes three cylinder chambers, each of the compression mechanisms (20, 30) has four cylinder chambers including the three cylinder chambers and the sub-cylinder chamber (C2).

The space radially outside the piston end plate (22*c*, 32*c*) is generally formed to allow orbiting of the piston end plate (22*c*, 32*c*), and does not contribute to the compression of the refrigerant. In the present embodiment, however, the space is used as the sub-cylinder chamber (C2), and the number of the cylinder chambers can be increased without wasting the space.

With the provision of the four cylinder chambers including the innermost cylinder chamber (23*a*), the inner cylinder chamber (23*b*), the outer cylinder chamber (23*c*) which are formed relative to the same plane, and the outermost cylinder chamber (23*d*) which is formed relative to a different plane, the compression mechanism (20, 30) including the four cylinder chambers can be provided with simple configuration. Thus, in increasing the number of the cylinder chambers, the parts count and the fabrication costs are not increased, the configuration is not complicated, and the compressor is not upsized. As a result, the eccentrically rotatable compression mechanism including a plurality of cylinder chambers can easily be put into practical use, and multistage compression can easily be performed. This can improve efficiency of the compressor.

With use of the blade (24) including the swing bushes (24*c*), the inner blade portion (B1), the first outer blade portion (B2), and the second outer blade portion (B3), the compression mechanism including the four cylinder chambers between a pair of the cylinder (21, 31) and the piston (22, 32) can easily be provided.

Since the first swing-permitting surface (n1) is formed in the outer peripheral surface of the inner piston portion (22*a*, 32*a*), and the second swing-permitting surface (n2) is formed in the outer peripheral surface of the piston end plate (22*c*, 32*c*), smooth movement of the cylinder (21, 31), the piston (22, 32), and the blade (24, 34) can be ensured during the operation of the compression mechanism (20, 30), and the compression can surely be performed in the four cylinder chambers.

In particular, when the blade (24, 34) swings about the swing bushes (24*c*, 34*c*), a fine gap is formed between the tip end of the inner blade portion (B1) and the first swing-permitting surface (n1), and a fine gap is formed between the tip end of the second outer blade portion (B3) and the second swing-permitting surface (n2). The gaps are dimensioned on the order of microns so that they are closed by the oil film of the lubricant supplied on the swing-permitting surfaces. Thus, leakage of the fluid from the discharge side to the suction side of the cylinder chamber (C1, C2) can be prevented, and the compression mechanism (20, 30) can smoothly be operated. In addition, the tip end of the blade is not worn, and slide loss does not occur. In this configuration, the blade is formed as an integrated member, and the increase in parts count can be prevented.

Since two sets of the cylinder (21, 31) and the piston (22, 32) are provided, and phases of the corresponding cylinders are shifted by 180°, moments of the cylinders can be canceled. This can reduce pulsation, oscillation, or noise.

Alternative of Embodiment

In the compression mechanism (40), the outermost cylinder chamber (23*d*) of the first compression mechanism unit (20) and the outermost cylinder chamber (33*d*) of the second compression mechanism unit (30) may constitute the cylinder chambers of the first stage compression mechanism. The outer cylinder chamber (23*c*) of the first compression mechanism unit (20) and the outer cylinder chamber (33*c*) of the second compression mechanism unit (30) may constitute the cylinder chambers of the second stage compression mechanism. The inner cylinder chamber (23*b*) of the first compression mechanism unit (20) and the inner cylinder chamber (33*b*) of the second compression mechanism unit (30) may constitute the cylinder chambers of the third stage compression mechanism. The innermost cylinder chamber (23*a*) of the first compression mechanism unit (20) and the innermost cylinder chamber (33*a*) of the second compression mechanism unit (30) may constitute the cylinder chambers of the fourth stage compression mechanism.

In this case, the suction pipe (61) and the discharge pipe (66) may be provided for each of the outer cylinder chamber (23*c*) and the inner cylinder chamber (23*b*) of the first compression mechanism unit (20), and the suction pipe (63) and the discharge pipe (68) may be provided for each of the outer cylinder chamber (33*c*) and the inner cylinder chamber (33*b*) of the second compression mechanism unit (30). In this configuration, the inner piston portions (22*a*, 32*a*) of the first and second compression mechanism units (20) and (30) may have the same axial lengths, and the outer piston portions (22*b*, 32*b*) of the first and second compression mechanism units (20) and (30) may have the same axial lengths.

This configuration can provide advantages similar to the advantages of the embodiment shown in FIG. 1.

Other Embodiments

The above-described embodiment may be modified in the following manner.

Figure 9:
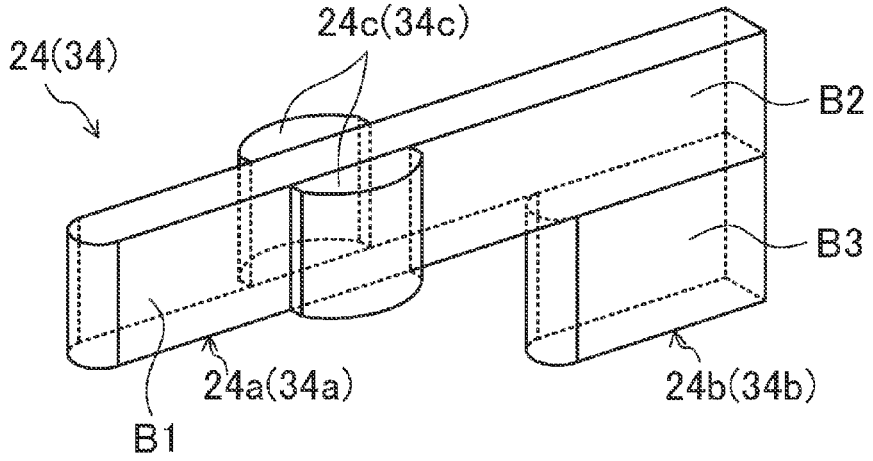
FIG. 9 is an enlarged perspective view of a blade of another embodiment.
Figure 10:
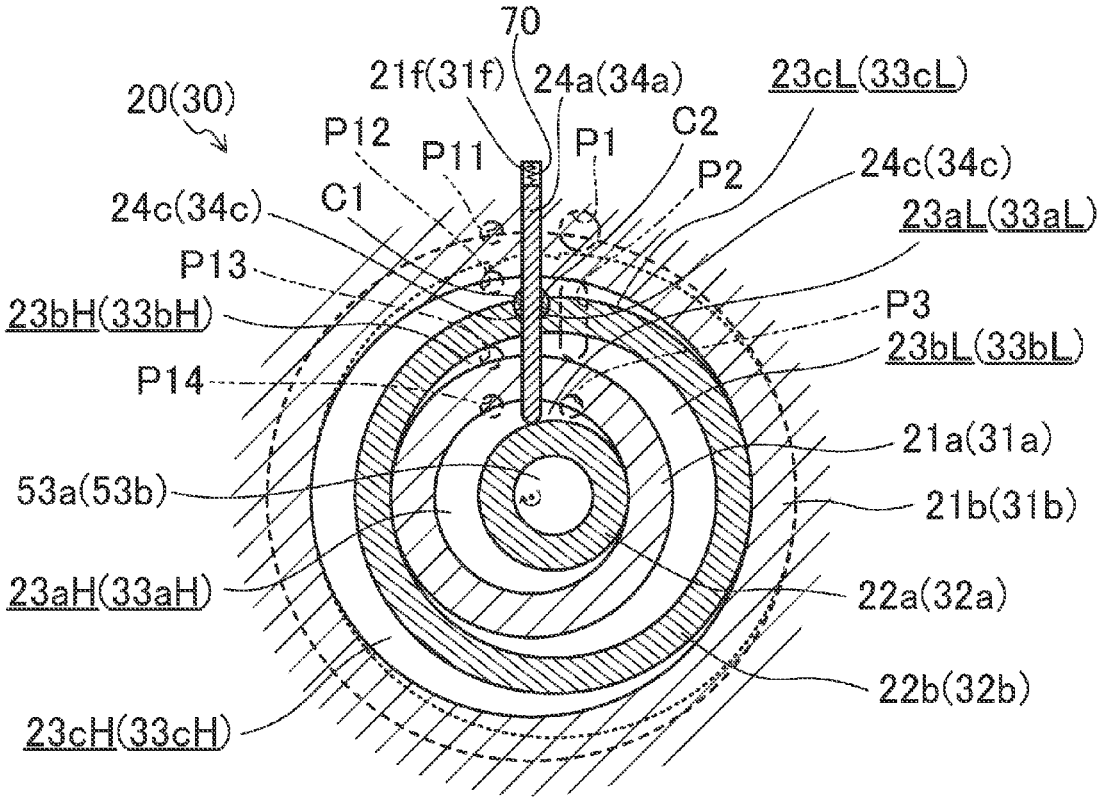
FIG. 10 is a horizontal cross-sectional view of another compression mechanism unit.

The blade (24, 34) may not necessarily be the integrated member, and may be made of a combination of two or more members. For example, in an example shown in FIG. 9, the inner blade portion (B1) and the first outer blade portion (B2) made of an integrated member, and the second outer blade portion (B3) and the swing bushes (24*c*) made of separated members are combined. In this example, the swing bushes (24*c*) are not integrated with the inner blade portion (B1), the first outer blade portion (B2), and the second outer blade portion (B3). Thus, as shown in FIG. 10, the notch (n1) in the inner piston portion (22*a*) and the notch (n2) in the piston end plate (22*c*) may not be formed. In place of the notches, a back pressure mechanism (70) for pressing the tip end of the inner blade portion (B1) to the inner piston portion (22*a*), and pressing the tip end of the second outer blade portion (B3) to the piston end plate (22*c*) is required.

Figure 11:
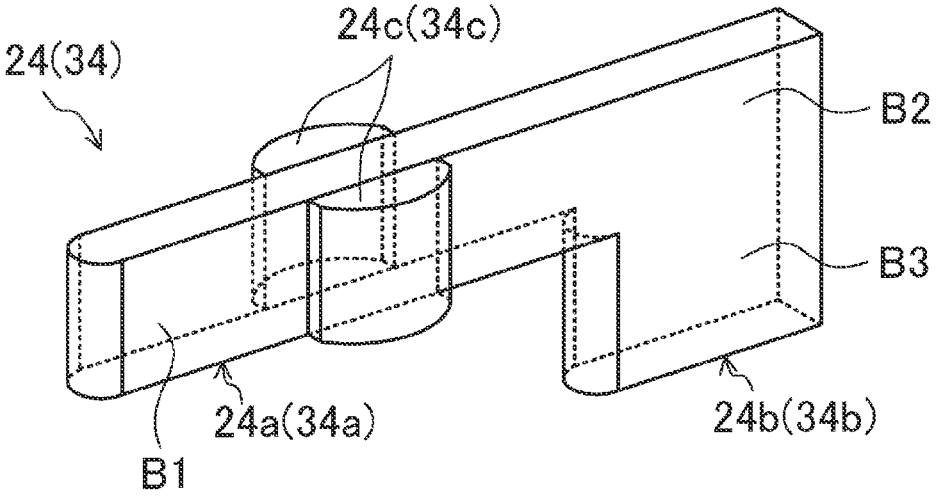
FIG. 11 is an enlarged perspective view of a blade of still another embodiment.

In an example shown in FIG. 11, the inner blade portion (B1), the first outer blade portion (B2), and the second outer blade portion (B3) are made of an integrated member, while the swing bushes (24*c*) are separated, and they are combined. In this case, the notch (n1) in the inner piston portion (22*a*) and the notch (n2) in the piston end plate (22*c*) may not be formed. However, the back pressure mechanism is required like the example shown in FIG. 9.

Figure 3:
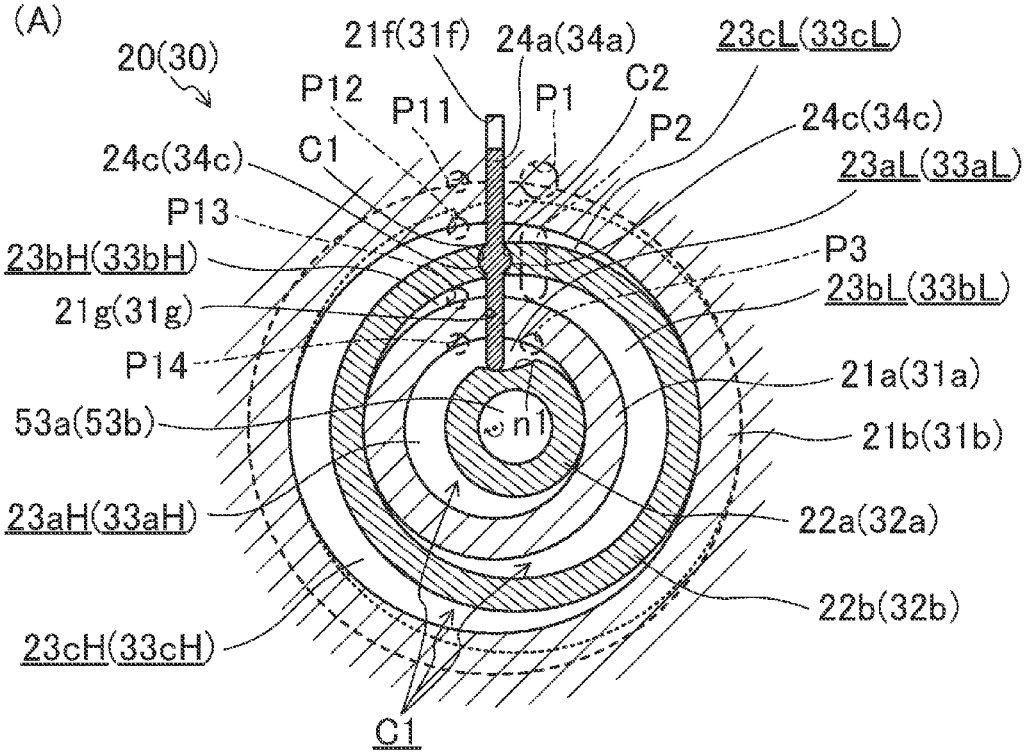
FIG. 3(A) is a horizontal cross-sectional view of a compression mechanism unit of the compressor of the embodiment of the present invention.
FIG. 3(B) is another horizontal cross-sectional view of the compression mechanism unit of the compressor.
Figure 3:
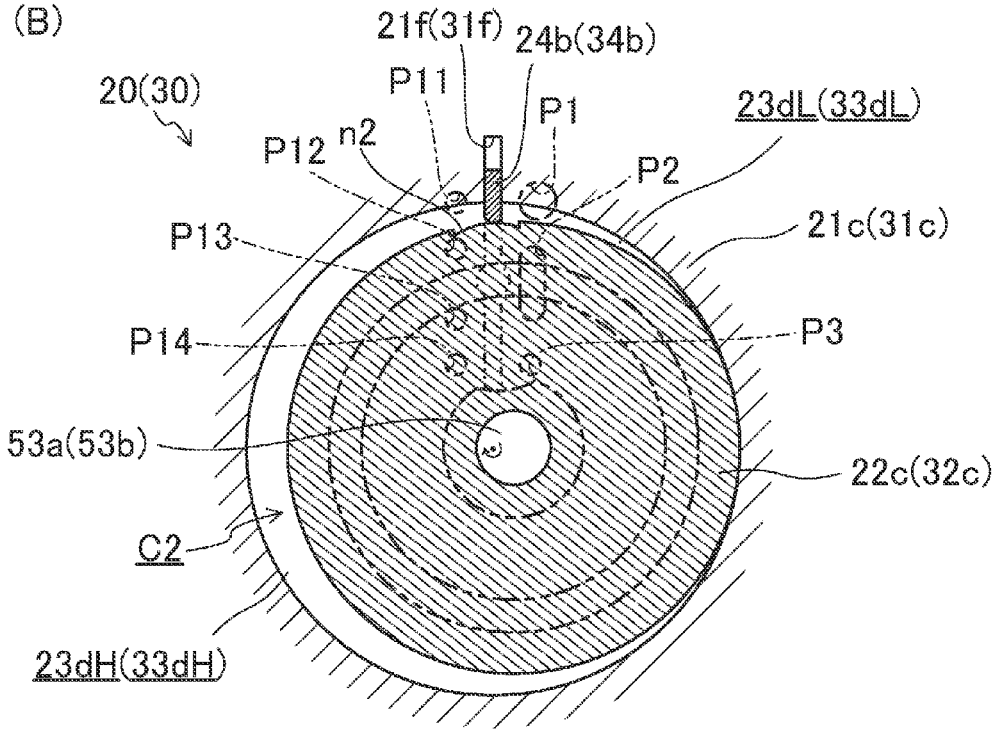
Figure 4:
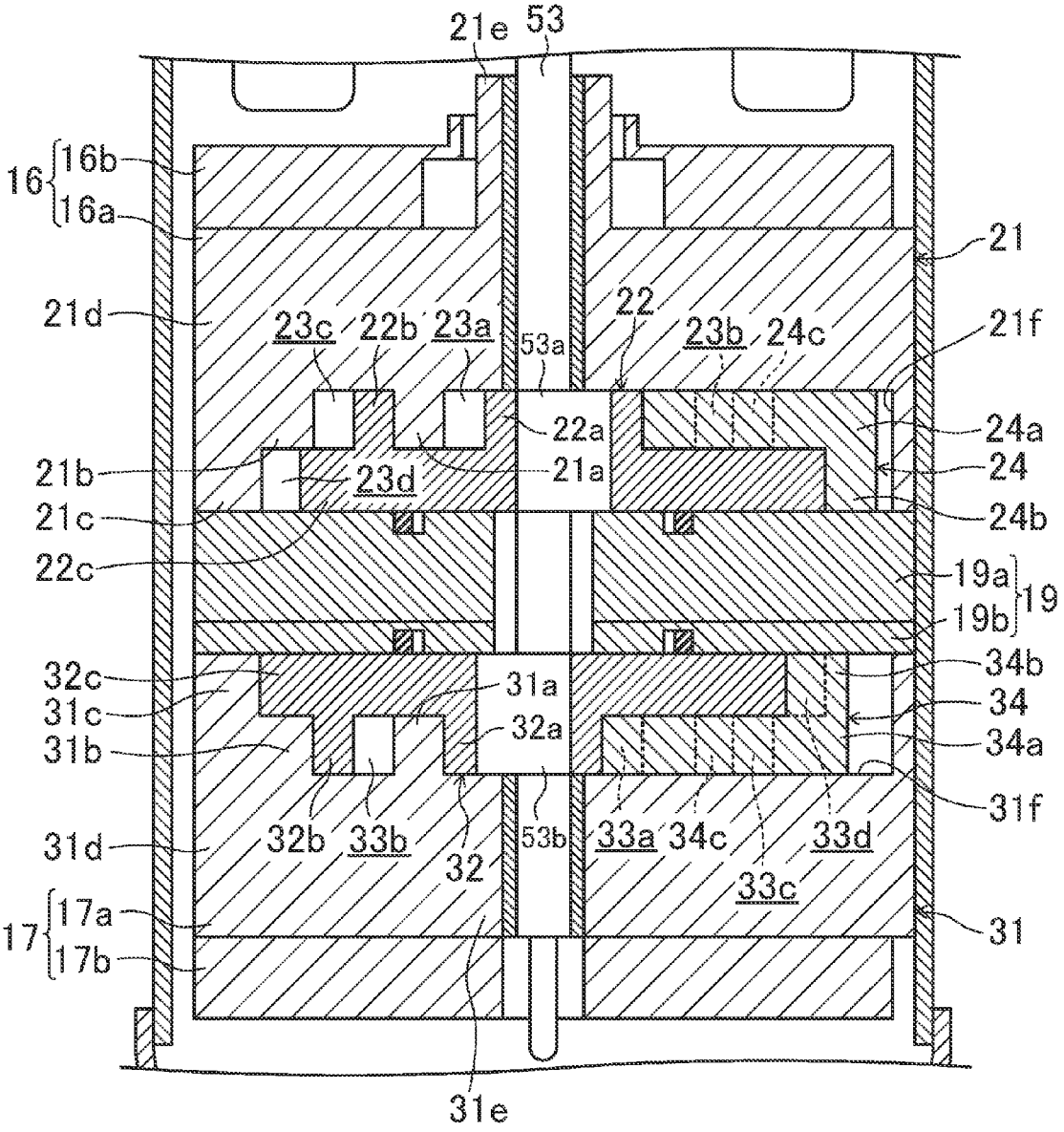
FIG. 4 is a partially enlarged view of another vertical cross-sectional view of the compressor of the embodiment of the present invention.
Figure 5:
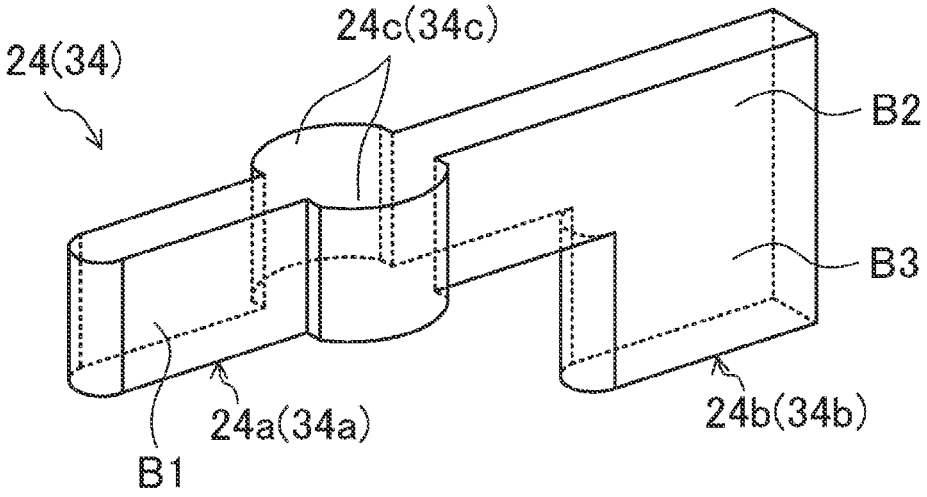
FIG. 5 is an enlarged perspective view of a blade of the embodiment of the present invention.
Figure 12:
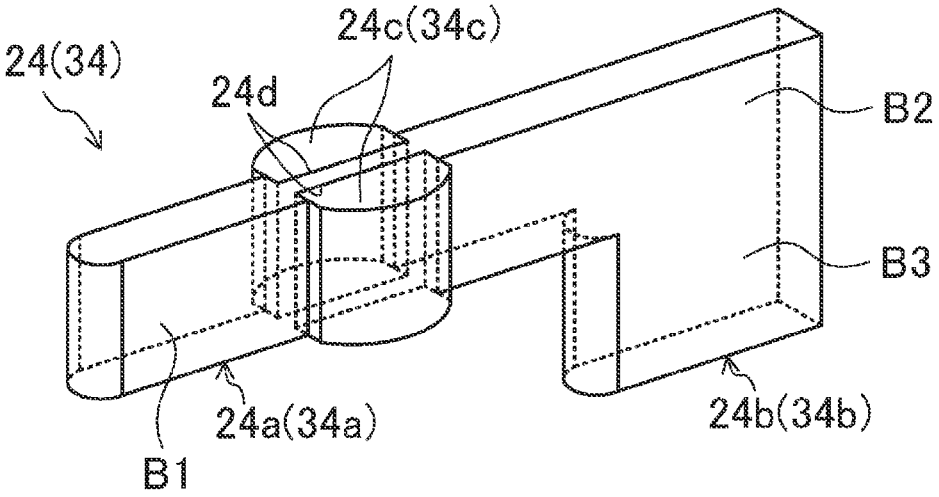
FIG. 12 is an enlarged perspective view of a blade of yet still another embodiment.

In an example shown in FIG. 12, the inner blade portion (B1), the first outer blade portion (B2), and the second outer blade portion (B3) are made of an integrated member, and the swing bushes (24*c*) are fitted and fixed in grooves (24*d*) formed in the middle of the long portion (24*a*). In this case, the blade (24) is integrated as shown in FIG. 3. Thus, the notch (n1) in the inner piston portion (22*a*) and the notch (n2) in the piston end plate (22*c*) are formed, and the back pressure mechanism may not be provided.

In the above-described embodiment, the compression mechanism (40) is configured to perform the four stage compression. However, in the present invention, the number of the compression stages may suitably be changed (single stage compression is also possible) as long as the space radially outside the piston end plate (22*c*, 32*c*) is used as the sub-cylinder chamber (C2). In the above-described embodiment, a single set of the cylinder (21, 31) and the piston (22, 32) forms the four cylinder chambers (23*a*, . . . , 23*d*, 33*a*, . . . , 33*d*). However, the number of the cylinder chambers may be changed, for example, by providing two chambers in the main cylinder chamber (C1), and a single chamber in the sub-cylinder chamber (C2). In the above-described embodiment, two sets of the cylinder (21, 31) and the piston (22, 32) are provided. However, a single set, or three or more sets of the cylinder (22, 32) and the piston (22, 32) may be provided.

The above-described embodiments have been set forth merely for the purposes of preferred examples in nature, and are not intended to limit the scope, applications, and use of the invention,

INDUSTRIAL APPLICABILITY

As described above, the present invention is useful for a rotary compressor in which a plurality of cylinder chambers are formed in a compression mechanism by providing an annular piston in an annular cylinder chamber of a cylinder.

What is claimed is:

1. A rotary compressor comprising:

a cylinder having an annular cylinder space;

a piston eccentrically disposed relative to the cylinder;

a drive shaft connected to the piston; and a blade, the piston having a piston portion eccentrically rotatable relative to the cylinder, and an end plate closing the cylinder space, the cylinder having an end plate storage space arranged to store the end plate of the piston in an eccentrically rotatable manner, the cylinder space forming a main cylinder chamber, and the end plate storage space forming a sub-cylinder chamber, the main cylinder chamber including an innermost cylinder chamber, an inner cylinder chamber, and an outer cylinder chamber sequentially arranged from inside to outside along a radial direction, the sub-cylinder chamber forming an outermost cylinder chamber located radially outside of the outer cylinder chamber, the cylinder having an inner cylinder portion, an outer cylinder portion, and an outermost cylinder portion arranged concentrically about a center of rotation of the drive shaft, the piston having an annular inner piston portion and an annular outer piston portion arranged concentrically with an eccentric part formed on the drive shaft, and the end plate being arranged concentrically with the inner and outer piston portions, the inner piston portion being arranged radially inside the inner cylinder portion, and the outer piston portion being arranged between the inner cylinder portion and the outer cylinder portion, the innermost cylinder chamber being formed between an outer peripheral surface of the inner piston portion and an inner peripheral surface of the inner cylinder portion, the inner cylinder chamber being formed between an outer peripheral surface of the inner cylinder portion and an inner peripheral surface of the outer piston portion, the outer cylinder chamber being formed between an outer peripheral surface of the outer piston portion and an inner peripheral surface of the outer cylinder portion, the outermost cylinder chamber being formed between an outer peripheral surface of the end plate and an inner peripheral surface of the outermost cylinder portion, and the blade being configured to divide each of the cylinder chambers into a suction side chamber and a discharge side chamber, the blade including a swing bush swingably connected to the outer piston portion, an inner blade portion located radially inside the swing bush and dividing each of the innermost cylinder chamber and the inner cylinder chamber into a suction side chamber and a discharge side chamber, a first outer blade portion located radially outside the swing bush and dividing the outer cylinder chamber into a suction side chamber and a discharge side chamber, and a second outer blade portion located radially outside the swing bush and dividing the outermost cylinder chamber into a suction side chamber and a discharge side chamber.

2. The rotary compressor of claim 1, wherein the cylinder has a slide groove arranged to slidably hold the blade, the blade being slidable along a direction of a surface of the blade, a first swing-permitting surface is formed in an outer peripheral surface of the inner piston portion to permit swing of the inner blade portion about the swing bush relative to the outer peripheral surface of the inner piston portion, and a second swing-permitting surface is formed in an outer peripheral surface of the end plate to permit swing of the second outer blade portion about the swing bush relative to the outer peripheral surface of the end plate.

3. The rotary compressor of claim 2, wherein the blade an integrated member, the first swing-permitting surface is formed on a segment of a circle forming a gap between the segment and a path of relative swing of the inner blade portion about the swing bush, and the second swing-permitting surface is formed on a segment of a circle forming a gap between the segment and a path of relative swing of the second outer blade portion about the swing bush.

4. The rotary compressor of claim 1, wherein the compression mechanism includes two or more sets of the cylinder and the piston.

5. The rotary compressor of claim 4, wherein the compression mechanism includes two sets of the cylinder and the piston.

* * * * *